US009478885B2

(12) United States Patent
MacDougall

(10) Patent No.: US 9,478,885 B2
(45) Date of Patent: Oct. 25, 2016

(54) ELECTRONIC MODULE PACKAGES AND COMMUNICATION ASSEMBLIES

(75) Inventor: Alan R. MacDougall, Beaverton, OR (US)

(73) Assignee: Tyco Electronics Corporation, Berwyn, PA (US)

( * ) Notice: Subject to any disclaimer, the term of this patent is extended or adjusted under 35 U.S.C. 154(b) by 739 days.

(21) Appl. No.: 13/212,650

(22) Filed: Aug. 18, 2011

(65) Prior Publication Data

US 2013/0045611 A1 Feb. 21, 2013

(51) Int. Cl.
*H01R 12/83* (2011.01)
*H01R 12/73* (2011.01)

(52) U.S. Cl.
CPC ..... *H01R 12/83* (2013.01); *H01R 12/73* (2013.01)

(58) Field of Classification Search
CPC ..... H01R 12/83
USPC ..... 439/67, 77, 341, 326, 295, 354, 70, 71, 439/482, 912.1, 76.1
See application file for complete search history.

(56) References Cited

U.S. PATENT DOCUMENTS 5,205,740 A * 4/1993 Frankeny et al. ..... 439/67
5,571,021 A * 11/1996 Kawabe et al. ..... 439/71
5,695,354 A 12/1997 Noda
5,947,764 A 9/1999 Pan et al.
5,980,267 A * 11/1999 Ayers et al. ..... 439/60
6,176,724 B1 * 1/2001 Klatt et al. ..... 439/326
6,361,358 B1 * 3/2002 Kajinuma ..... 439/497
6,881,085 B2 * 4/2005 Yahiro et al. ..... 439/326
7,232,315 B2 * 6/2007 Uchida et al. ..... 439/67
7,540,742 B2 6/2009 Hardell
7,654,829 B1 * 2/2010 Chuang et al. ..... 439/67
7,750,446 B2 * 7/2010 Fjelstad et al. ..... 257/676
2005/0048810 A1 * 3/2005 Howie et al. ..... 439/67
2006/0292900 A1 * 12/2006 Pabst et al. ..... 439/67

FOREIGN PATENT DOCUMENTS

JP 2000-58198 A 2/2000

* cited by examiner

*Primary Examiner* — Abdullah Riyami
*Assistant Examiner* — Harshad Patel

(57) ABSTRACT

An electronic module package including an electronic module configured to receive input signals and process the input signals to provide output signals. The electronic module package also includes an interposer that has a substrate with opposite board and module surfaces. The electronic module is mounted to the module surface. The interposer includes electrical contacts along the module surface that are communicatively coupled to the electronic module through the substrate. The electronic module package also includes a connector receptacle having a receptacle housing coupled to the interposer. The receptacle housing defines a reception space that is located over and permits access to the electrical contacts. The connector receptacle is configured to receive an electrical connector within the reception space to electrically couple the electrical contacts and the electrical connector. The connector receptacle holds the electrical connector therein in a mated position.

17 Claims, 6 Drawing Sheets

ELECTRONIC MODULE PACKAGES AND COMMUNICATION ASSEMBLIES

BACKGROUND OF THE INVENTION

The invention relates generally to electronic module packages and communication assemblies that are configured to be coupled to circuit boards in communication systems.

Electronic module packages may be used to interconnect an electronic module (e.g., CPU, ASIC) and a circuit board (e.g., motherboard). For example, in a land grid array (LGA) assembly, the electronic module is mounted onto one surface of an interposer. The interposer includes an array of board contacts on an opposite surface, which is mounted onto a socket having an array of socket contacts that engage the array of board contacts. The electronic module receives input data signals, processes the input data signals in a predetermined manner, and provides output data signals. In existing electrical systems that include such LGA assemblies, the data signals may be transmitted from the electronic module through the socket contacts to a motherboard, along the motherboard, and to another electrical component that is mounted to the motherboard. For instance, the data signals may be directed along a signal path that extends from the electronic module, through electrical contacts that join the electronic module and the interposer, through conductive vias of the interposer, through socket contacts that join the interposer and the motherboard, and through conductive traces along the motherboard to a connector having the other electrical component coupled thereto.

However, as the data signals propagate across the interfaces between the various components and along the conductive traces, the data signals may experience impedance mismatches that degrade signal quality. As transmission speeds increase (e.g., 10 Gb/s or faster), impedance mismatches may have an even greater effect on signal integrity. In addition, as the length of the signal path increases along the circuit board, data signals may experience more unwanted interactions that negatively affect the signal integrity.

Accordingly, there is a need for an electronic module package and assembly that reduces negative effects on signal integrity in an electrical system.

BRIEF DESCRIPTION OF THE INVENTION

In one embodiment, an electronic module package is provided that includes an electronic module configured to receive input signals and process the input signals to provide output signals. The electronic module package also includes an interposer that has a substrate with opposite board and module surfaces. The electronic module is mounted to the module surface. The interposer includes electrical contacts along the module surface that are communicatively coupled to the electronic module through the substrate. The electronic module package also includes a connector receptacle having a receptacle housing coupled to the interposer. The receptacle housing defines a reception space that is located over and permits access to the electrical contacts. The connector receptacle is configured to receive an electrical connector within the reception space to electrically couple the electrical contacts and the electrical connector. The connector receptacle holds the electrical connector therein in a mated position.

In another embodiment, a communication assembly is provided that includes an electronic module package. The electronic module package includes an interposer with opposite board and module surfaces and an electronic module mounted to the module surface. The electronic module package also includes electrical contacts along the module surface that are communicatively coupled to the electronic module through the interposer. The communication assembly also includes a connector receptacle having a receptacle housing coupled to the interposer. The receptacle housing defines a reception space that is located over and permits access to the electrical contacts. The communication assembly also includes a cable connector assembly having a flex cable and an electrical connector coupled to the flex cable. The electrical connector has connector contacts. The connector receptacle is configured to receive the electrical connector within the reception space to electrically couple the electrical contacts and the connector contacts. The connector receptacle holds the electrical connector in a mated position.

In yet another embodiment, a communication assembly is provided that includes a connector receptacle having a receptacle housing that defines a reception space. The reception space is located over and permits access to electrical contacts. The communication assembly also includes a cable connector assembly that has a mating end and includes a flex cable with opposite first and second sides. The cable connector assembly includes an electrical connector that is terminated to the first side of the flex cable at the mating end and also a stiffener that is coupled to the second side at the mating end. The stiffener has a length that extends from proximate to a distal cable edge of the cable connector assembly to beyond the electrical connector. The electrical connector is configured to engage the electrical contacts when inserted into the reception space.

DETAILED DESCRIPTION OF THE INVENTION

Figure 1:
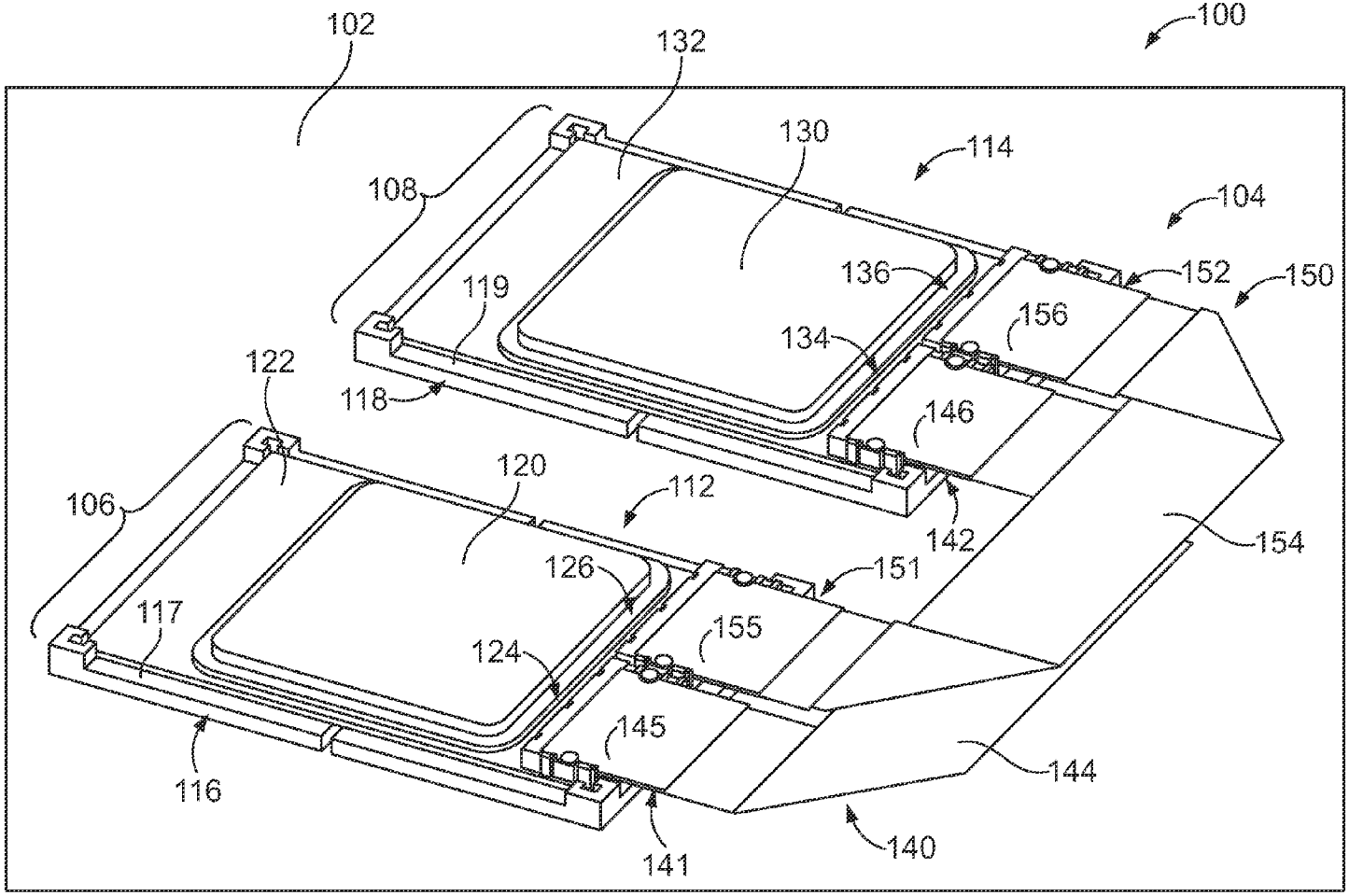
FIG. 1 is a perspective view of a communication system formed in accordance with one embodiment.

FIG. 1 is a perspective view of a communication system 100 formed in accordance with one embodiment. The communication system 100 includes a primary circuit board 102 (e.g., a motherboard) and a communication assembly 104 mounted thereon. The communication assembly 104 includes first and second electronic module packages 112, 114 mounted to first and second socket assemblies 116, 118, respectively. In an exemplary embodiment, the electronic module package 112 and the socket assembly 116 constitute a first area array assembly 106, and the electronic module package 114 and the socket assembly 118 constitute a second area array assembly 108 For example, the area array assemblies 106, 108 may be land-grid array (LGA) assemblies or pin-grid array (PGA) assemblies. In other embodiments, the area array assemblies 106, 108 could be ball-grid array (BGA) assemblies with or without the socket assemblies 116, 118.

The electronic module package 112 includes an electronic module 120 and an interposer 122 having the electronic module 120 mounted thereon. The electronic module package 114 includes an electronic module 130 and an interposer 132 having the electronic module 130 mounted thereon. The socket assemblies 116, 118 include respective socket frames 117, 119 that define module-receiving spaces where the electronic module packages 112, 114, respectively, are positioned. Although not shown, the module-receiving spaces of the socket frames 117, 119 include electrical contacts therein that engage the interposers 122, 132, respectively. The electrical contacts between the primary circuit board 102 and the interposers 122, 132 electrically connect the electronic modules 120, 130, respectively, to the primary circuit board 102.

The electronic modules 120, 130 are each configured to receive input signals and process the input signals to provide output signals. For example, the electronic modules 120, 130 may include integrated circuits (e.g., ASICs, processors, and the like). In the illustrated embodiment, the integrated circuits of the electronic modules 120, 130 are assembled with a heat spreader.

The electronic module package 112 also includes input/output (I/O) ports 124, 126 that are coupled to the interposer 122. The I/O ports 124, 126 are communicatively coupled to the electronic module 120 through the interposer 122. As shown in FIG. 1, the I/O ports 124, 126 can be located immediately adjacent to the electronic module 120. In an exemplary embodiment, the I/O ports 124, 126 are provided on the same side of the interposer 122 as the electronic module 120. The electronic module package 114 also includes input/output (I/O) ports 134, 136 that are coupled to the interposer 132. The I/O ports 134, 136 are communicatively coupled to the electronic module 130 and can be located immediately adjacent to the electronic module 130.

The communication assembly 104 also includes cable connector assemblies 140, 150. The cable connector assembly 140 communicatively couples, the I/O ports 124, 134 of the electronic module packages 112, 114, respectively, and the cable connector assembly 150 communicatively couples the I/O ports 126, 136 of the electronic module packages 112, 114, respectively.

The cable connector assembly 140 has first and second mating ends 141, 142 and a flex cable 144 that extends between the first and second mating ends 141, 142. In an exemplary embodiment, the cable connector assembly 140 includes first and second stiffeners 145, 146 at the mating ends 141, 142, respectively. The first and second stiffeners 145, 146 are configured to mechanically engage the I/O ports 124, 134, respectively. The mating ends 141, 142 may be held by the I/O ports 124, 134 in mated positions to prevent the mating ends 141, 142 from being inadvertently removed from the corresponding I/O ports 124, 134.

The cable connector assembly 150 has the mating ends 151, 152 and a flex cable 154 that extends between the mating ends 151, 152. In an exemplary embodiment, the cable connector assembly 150 includes first and second stiffeners 155, 156 at the mating ends 151, 152. The first and second stiffeners 155, 156 are configured to mechanically engage the I/O ports 126, 136, respectively. The mating ends 151, 152 may be held by the I/O ports 126, 136 in mated positions to prevent the mating ends 151, 152 from being inadvertently removed from the corresponding I/O ports 126, 136.

Figure 8:
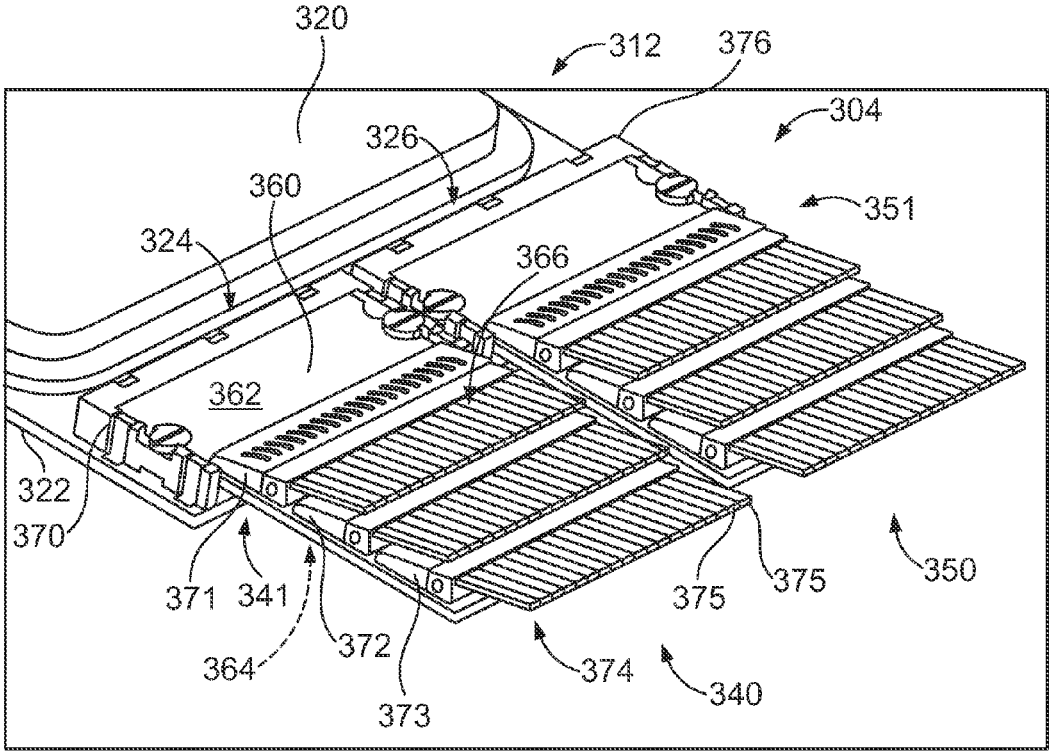
FIG. 8 is a perspective view of a communication assembly formed in accordance with one embodiment.

The flex cables 144, 154 include communication paths (e.g., electrical or optical paths) enclosed by a material that permits movement of the paths (e.g., through flexing or bending) and that protects the communication paths. As used herein, a "flex cable" may include a bundle of individual cables or wires. Various types of flex cables can be used. In the illustrated embodiment in FIG. 1, the flex cables 144, 154 are flex circuits. Flex circuits include a plurality of stacked flexible layers with conductive traces deposited therebetween. However, in other embodiments, the flex cables 144, 154 can include a plurality of separate wires that are joined at the respective mating ends of the flex cables 144, 154. Such wires can include only one conductor or a pair of conductors (e.g., twisted differential pair of conductors). The flex cables 144, 154 can also be ribbon cables. In other embodiments, the flex cables 144, 154 may include twin-axial cables 375 as shown in FIG. 8. In alternative embodiments, the flex cables 144, 154 may include optical fibers.

The communication system 100 can transmit signals directly between the electronic module packages 112, 114 through the cable connector assemblies 140, 150. In some embodiments, the cable connector assemblies 140, 150 permit faster transmission of signals between the electronic module packages 112, 114 than if the signals were transmitted between the electronic module packages 112, 114 through the primary circuit board 102. For example, the cable connector assemblies 140, 150 may be capable of transmitting signals at a speed of at least about 10 Gb/s or 15 Gb/s In more particular embodiments, the cable connector assemblies 140, 150 may be capable of transmitting signals at a speed of at least about 20 Gb/s or 25 Gb/s.

Although the electronic module packages 112, 114 are each shown as having a pair of I/O ports 124, 126 and 134, 136, respectively, embodiments described herein may include only one I/O port or more than two I/O ports. Moreover, communication systems and assemblies are not required to communicatively couple two electronic module packages as shown in FIG. 1. For example, other embodiments may include an electronic module package that is communicatively coupled to a different type of electrical component.

Figure 2:
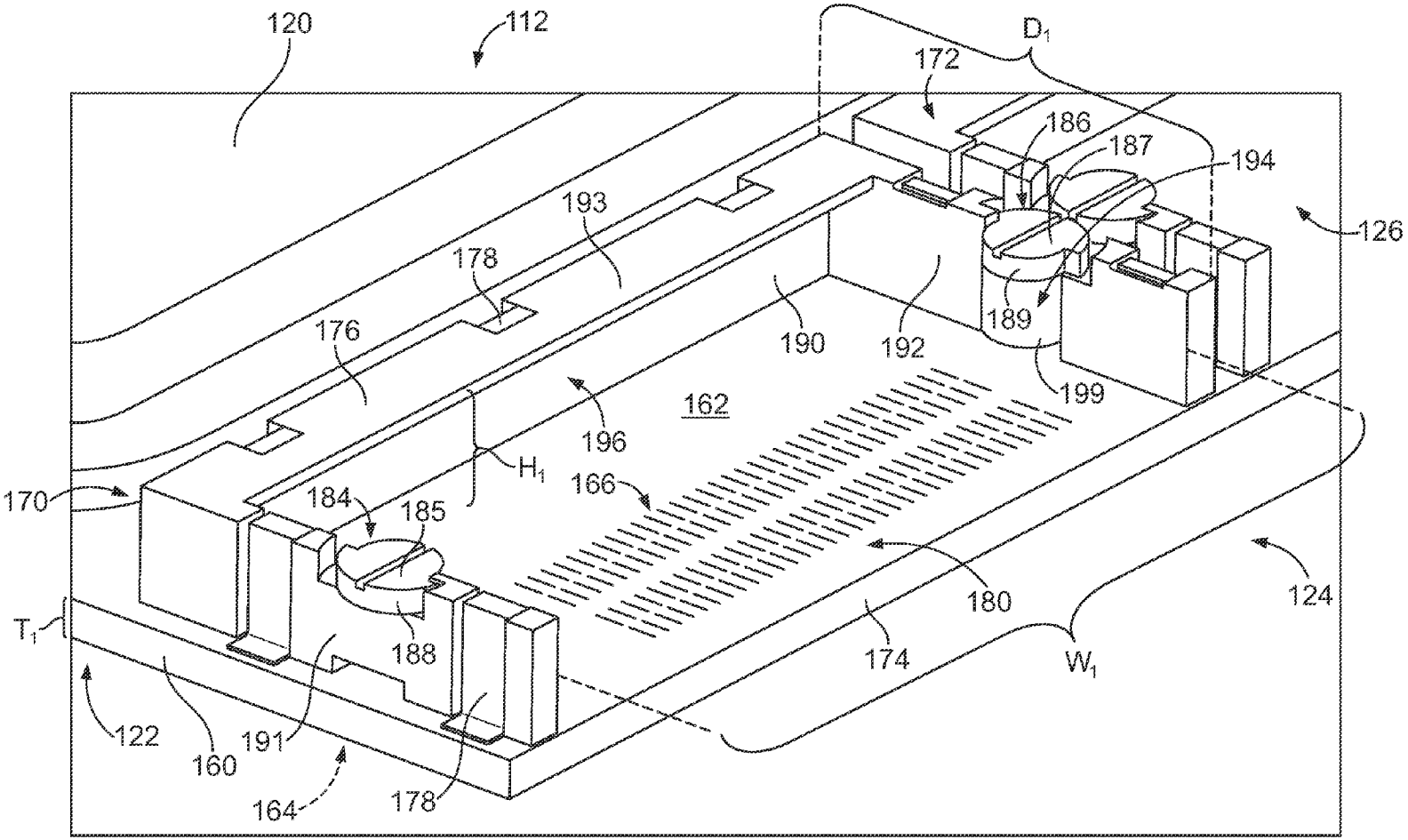
FIG. 2 is an enlarged view of a portion of an electronic module package that may be used with the communication system of FIG. 1.

FIG. 2 is an enlarged view of the electronic module package 112 illustrating the I/O port 124 in greater detail. Although the following is with specific reference to the electronic module package 112 and the I/O port 124, the following may also be applied to the I/O port 126 or the electronic module package 114 (FIG. 1) with the I/O ports 134, 136 (FIG. 1). The interposer 122 includes a substrate 160 having a module surface 162 and a board surface 164. The module and board surfaces 162, 164 face in opposite directions and a thickness $T_1$ of the substrate 160 is defined therebetween. The electronic module 120 is mounted on the module surface 162.

The interposer 122 also includes an array of electrical contacts 166 along the module surface 162. In an exemplary embodiment, the electrical contacts 166 are contact pads, but the electrical contacts 166 may be other types of contacts in other embodiments. The electrical contacts 166 are communicatively coupled to the electronic module 120 through the substrate 160. The substrate 160 can include a plurality of stacked layers having conductive traces and vias therebetween that form conductive pathways between the electronic module 120 and the electrical contacts 166.

The electronic module package 112 includes first and second connector receptacles 170, 172 coupled to the interposer 122. Although first and second connector receptacles 170, 172 are shown in FIG. 2, the electronic module package 112 may have only one connector receptacle or more than two connector receptacles (e.g., a third, fourth, et seq.). The connector receptacles 170, 172 can be located adjacent to each other as shown in FIG. 2. In an exemplary embodiment, the connector receptacles 170, 172 are located proximate to a substrate edge 174 of the interposer 122 and immediately adjacent to the electronic module 120. Although the following description is with reference to the connector receptacle 170, the description may be similarly applied to the connector receptacle 172.

The connector receptacle 170 includes a receptacle housing 176 that is coupled to the interposer 122. In the illustrated embodiment, the receptacle housing 176 is mounted directly to the module surface 162. The receptacle housing 176 can be affixed to the module surface 162 by attaching the receptacle housing 176 through solder nails 178. However, other methods of attaching the receptacle housing 176 to the module surface 162 can include fasteners (e.g., screws, rivets, clips, plugs, solder posts and the like) and/or an adhesive. In the illustrated embodiment, the receptacle housing 176 includes a dielectric material that is integrally formed through a molding process such that the receptacle housing 176 is one continuous piece of material. In other embodiments, the receptacle housing 176 may be constructed from multiple components that are coupled together.

The connector receptacle 170 is configured to receive the mating end 141 (FIG. 1) during a mating operation where an electrical connector 182 (shown in FIG. 3) electrically engages the electrical contacts 166. To this end, the receptacle housing 176 defines a reception space 180 that is located over and permits access to the electrical contacts 166. The electrical contacts 166 and the module surface 162 are exposed in the reception space 180. The receptacle housing 176 includes a plurality of housing walls 190-193. The interior surfaces of the housing walls 190-193 partially define the reception space 180 and are configured to align the electrical connector 182 so that the electrical contacts 166 are electrically engaged.

In the illustrated embodiment, the housing walls 190-193 include a base wall 190, sidewalls 191, 192, and a leverage wall 193. The base and leverage walls 190, 193 can extend between and couple to the sidewalls 191, 192. The leverage wall 193 is spaced apart from the interposer 122. The reception space 180 has a width $W_1$ measured between the sidewalls 191, 192, a depth $D_1$ that extends to the base wall 190, and a height $H_1$ that extends from the module surface 162 to a top of the receptacle housing 176 (e.g., the leverage wall 193) or the reception space 180. The reception space 180 is sized and shaped to receive the mating end 141 including the electrical connector 182. The reception space 180 has a plurality of spatial regions. For example, the connector receptacle 170 can include a body region 194 and a slot region 196. The slot region 196 may be a portion of the reception space 180 that is defined between the interposer 122, the base wall 190, and the leverage wall 193. The body region 194 can be a remaining portion of the reception space 180 that is defined between the sidewalls 191, 192 and is not covered by the leverage wall 193.

In some embodiments, the connector receptacle 170 also includes one or more retention devices. For example, in the illustrated embodiment, the connector receptacle 170 includes a pair of retention devices 184, 186 that are coupled to the sidewalls 191, 192, respectively. The retention devices 184, 186 are separated from each other with the reception space 180 therebetween and are equally spaced apart from the leverage wall 193. The retention devices 184, 186 include respective actuators 185, 187 that are configured to engage the mating end 141 when the mating end 141 is in the reception space 180 to hold the electrical connector 182 in a mated position (shown in FIG. 6). The actuators 185, 187 may be movable between locked and unlocked positions. In the illustrated embodiment, the actuators 185, 187 are rotatable bodies having contoured heads 188, 189, respectively. As shown in FIG. 2, the actuators 185, 187 are in unlocked positions so that the mating end 141 may be advanced into the reception space 180. In alternative embodiments, the actuators 185, 187 may be moved in other manners to engage the mating end 141. For instance, the actuators 185, 187 may be slidable in a linear manner over the mating end 141 when the mating end 141 is in a mated position.

The receptacle housing 176 may also include one or more grip features 199. The grip features 199 are configured to prevent the electrical connector 182 and/or the mating end 141 from being inadvertently removed. The electrical connector 182 and the grip features 199 may be shaped relative to each other to prevent inadvertent removal of the electrical connector 182. In an exemplary embodiment, the grip features 199 extend inwardly from the sidewalls 191, 192 into the reception space 180. (The grip feature of the sidewall 191 is not shown.) in alternative embodiments, the grip features 199 could be, for example, recesses that extend into the sidewalls 191, 192 or projections that extend from the module surface 162 into the reception space 180.

Figure 3:
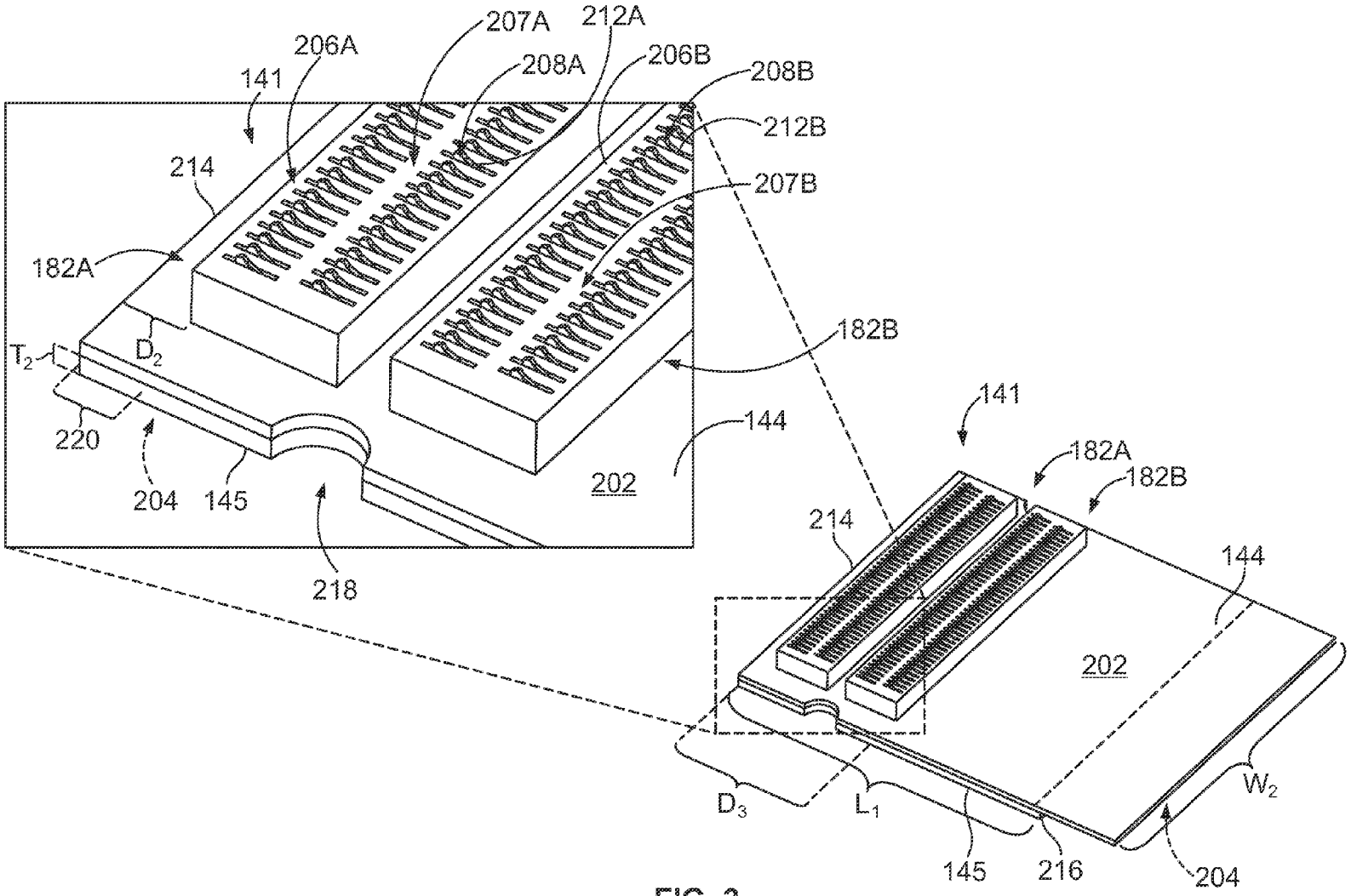
FIG. 3 is an isolated view and an enlarged portion of a cable connector assembly that may be used with the communication system of FIG. 1.

FIG. 3 shows an isolated view of the mating end 141 and an enlarged portion of the mating end 141. The flex cable 144 has first and second sides 202, 204. In an exemplary embodiment, electrical conductors are located between the first and second sides 202, 204 and extend from the mating end 141 to the mating end 142 (FIG. 1). The mating end 141 includes first and second electrical connectors 182A, 182B that are coupled to the first side 202 of the flex cable 144. In the illustrated embodiment, the cable connector assembly 140 includes two electrical connectors 182A, 182B. However, other embodiments can include only one or more than two electrical connectors 182. In an exemplary, the electrical connectors 182A, 182B extend along a width $W_2$ of the flex cable 144.

The electrical connector 182A is spaced apart from a distal cable edge 214 of the mating end 141 by a separation distance $D_2$. The electrical connector 182B is located at most a distance $D_3$ away from the distal cable edge 214 measured lengthwise along the flex cable 144. In other words, the electrical connector 182B does not extend beyond a point that is the distance $D_3$ away from the distal cable edge 214. The electrical connectors 182A, 182B include connector bodies 206A, 206B and a plurality of connector contacts 208A, 208B that are held by the connector bodies 206A, 206B. The connector bodies 206A, 206B include respective mating faces 207A, 207B. In an exemplary embodiment, the connector contacts 208A, 208B project beyond the mating faces 207A, 207B such that the connector contacts 208A, 208B are exposed to the exterior of the connector body 206A, 206B. The mating faces 207A, 207B can extend substantially parallel to the first side 202 along the mating end 141 and/or the stiffener 145.

The connector, contacts 208A, 208B are terminated to respective conductors of the flex cable 144. In an exemplary embodiment, the connector contacts 208A, 208B are resilient and deflectable contacts that include resilient arms 212A, 212B. The resilient arms 212A, 212B are configured to move within corresponding contact slots 210A, 210B (shown in FIG. 5) when engaged by the electrical contacts 166 (FIG. 2). The contact slots 210A, 210B open onto the mating faces 207A, 207B, respectively. In alternative embodiments, the connector contacts 208A, 208B may be other types of electrical contacts (e.g., contact pads).

The stiffener 145 is also coupled to the flex cable 144 at the mating end 141. As shown, the stiffener 145 is coupled to the second side 204 of the flex cable 144. The stiffener 145 can be bonded to the second side 204 using an adhesive. The stiffener 145 extends a length $L_1$ from proximate to the distal cable edge 214 of the mating end 141 to a point 216 (indicated by dashed lines) along the flex cable 144. The length $L_1$ of the stiffener 145 may be configured so that the stiffener 145 may be gripped and held by an individual or machine. A tool may be used by the individual or machine for holding the stiffener 145 or the mating end 141. The length $L_1$ may also be configured to extend beyond the electrical connector 182B. For example, the length $L_1$ may be more than about 1.5× the distance $D_3$ or more than about 2× the distance $D_3$.

Figure 5:
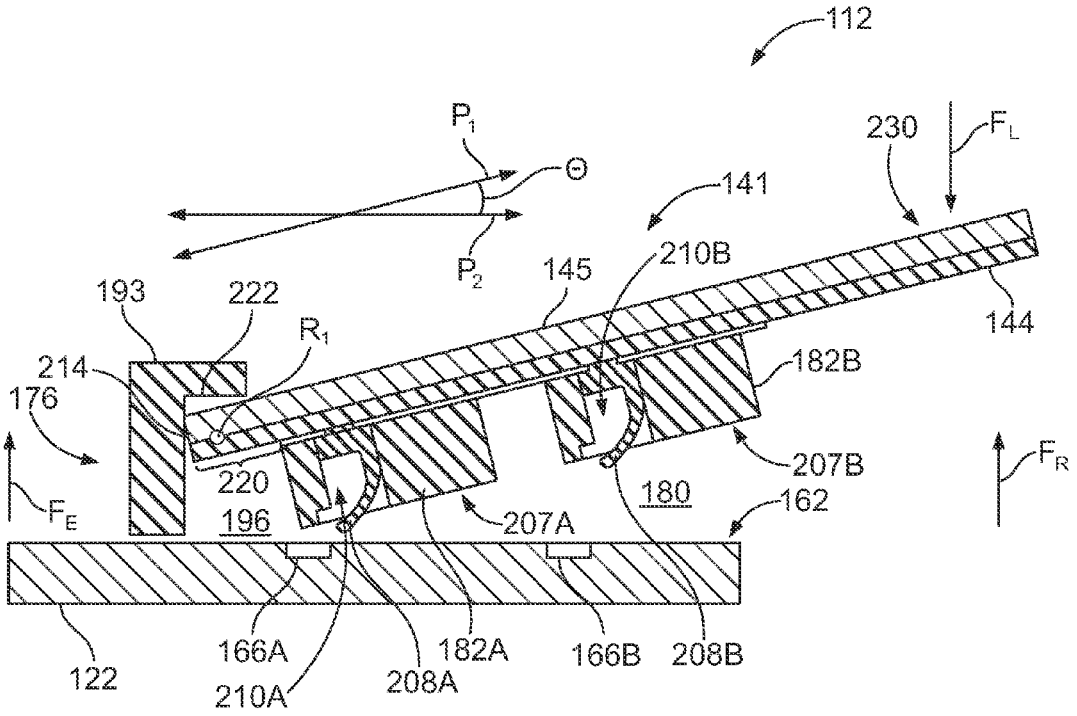
FIG. 5 is a cross-section of a portion of the electronic module package during the mating operation.

The stiffener 145 has a thickness $T_2$ and comprises a rigid material that is capable of withstanding a loading force $F_L$ (shown in FIG. 5). The rigid material may be metal or a printed circuit board (PCB)-like material. A section of the mating end 141 that is proximate to the cable edge 214 may be referred to as a lever section 220. In the illustrated embodiment, the lever section 220 includes at least a portion of the stiffener 145.

In some embodiments, the mating end 141 includes one or more grip features 218. The grip features 218 may be sized and shaped relative to the grip features 199 (FIG. 2) of the receptacle housing 176 (FIG. 2). In the illustrated embodiment, the grip features 218 are recesses that extend into the stiffener 145 and the flex cable 144. In other embodiments, the grip features 218 may constitute protrusions that are configured to extend into recesses of the receptacle housing 176. In alternative embodiments, the cable connector assembly 140 may not include the grip features 199.

Figure 4:
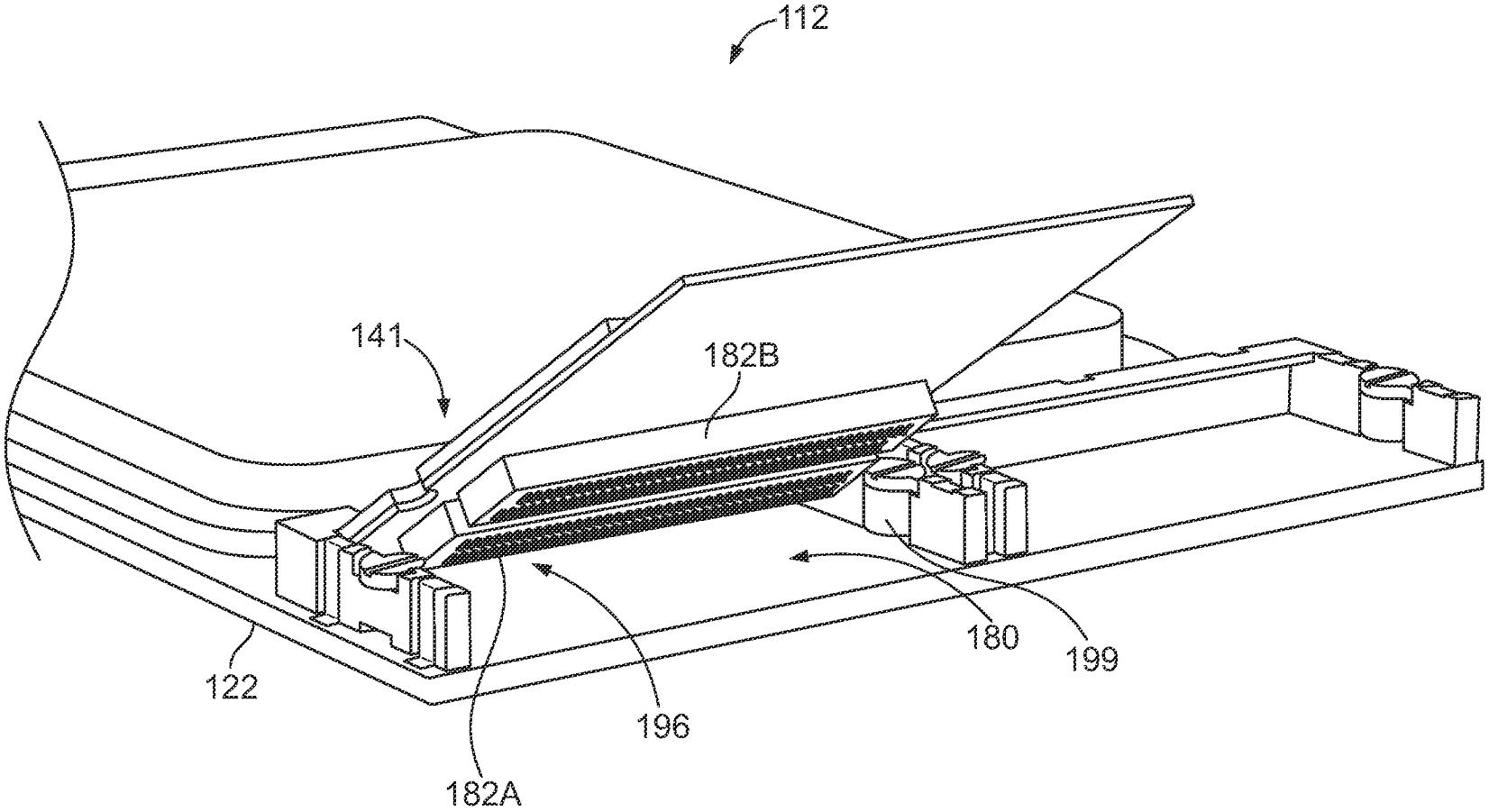
FIG. 4 is a perspective view of the electronic module package receiving the cable connector assembly during a mating operation.

FIGS. 4 and 5 are a perspective view and a cross-sectional view, respectively, of the electronic module package 112 when the mating end 141 is inserted into the reception space 180. FIGS. 4 and 5 illustrate the mating end 141 in the inserted position. To mate the electrical connectors 182A, 182B to the interposer 122, the distal cable edge 214 (FIG. 5) of the mating end 141 is advanced into the reception space 180. More specifically, the lever section 220 (FIG. 5) of the mating end 141 is inserted into the slot region 196.

With reference to FIG. 5, the interior surfaces of the receptacle housing 176 include a load surface 222 that faces the module surface 162. The load surface 222 may be an interior surface of the leverage wall 193. The load surface 222 and the module surface 162 may define the slot region 196 of the reception space 180 therebetween. In the inserted position, at least a portion of the lever section 220 is positioned between the load and module surfaces 222, 162.

In the inserted position, the mating end 141 is oriented at an angle relative to the module surface 162 with the lever section 220 in the slot region 196. For example, the stiffener 145 and/or the mating faces 207A, 207B extend parallel to an insertion plane $P_1$ as shown in FIG. 5. The module surface 162 extends along a contact plane $P_2$. When the mating end 141 is in the inserted position, the insertion plane $P_1$ forms an acute angle θ relative to the contact plane $P_2$. The acute angle θ may be, for example, greater than about 10° and less than about 60°.

To engage the connector contacts 208A, 208B with the electrical contacts 166A, 166B, respectively, the mating end 141 is substantially rotated or pivoted about the lever section 220 such that the connector contacts 208A, 208B are moved toward the electrical contacts 166A, 166B. The mating end 141 may be pivoted about an axis of rotation $R_1$ that extends along the width $W_2$ (FIG. 3) of the flex cable 144. When the connector contacts 208A engage the electrical contacts 166A, a resilient force $F_R$ in a direction away from the module surface 162 may be applied to the electrical connector 182A or the mating end 141. The connector contacts 208A may collectively resist deflection as the connector contacts 208A engage the electrical contacts 166A. In alternative embodiments, the connector contacts 208A may include contact pads and the electrical contacts 166A may include beams or arms that resist deflection. As used herein, the term "pivot" does not limit the mating end 141 to only rotational motion during the mating operation. For example, the mating end 141 may also slide along the module surface 162 before, after, or during the rotational motion.

Accordingly, embodiments described herein may facilitate engaging the electrical connectors 182A, 182B to the interposer 122 by utilizing the mating end 141 as a lever mechanism. In particular embodiments, an individual or machine may use the stiffener 145 as a lever to increase a mechanical advantage during the mating operation. For instance, when the mating end 141 is in the inserted position as shown in FIG. 5, the individual may press the stiffener 145 at a press point 230 and apply the loading force $F_L$. The individual or machine may also use a tool for applying the loading force $F_L$. For instance, the press point 230 may be located beyond the electrical connector 182B and before the point 216 (FIG. 3). The individual may push the stiffener 145 in a direction toward the module surface 162 such that the mating end 141 pivots toward the module surface 162.

Figure 6:
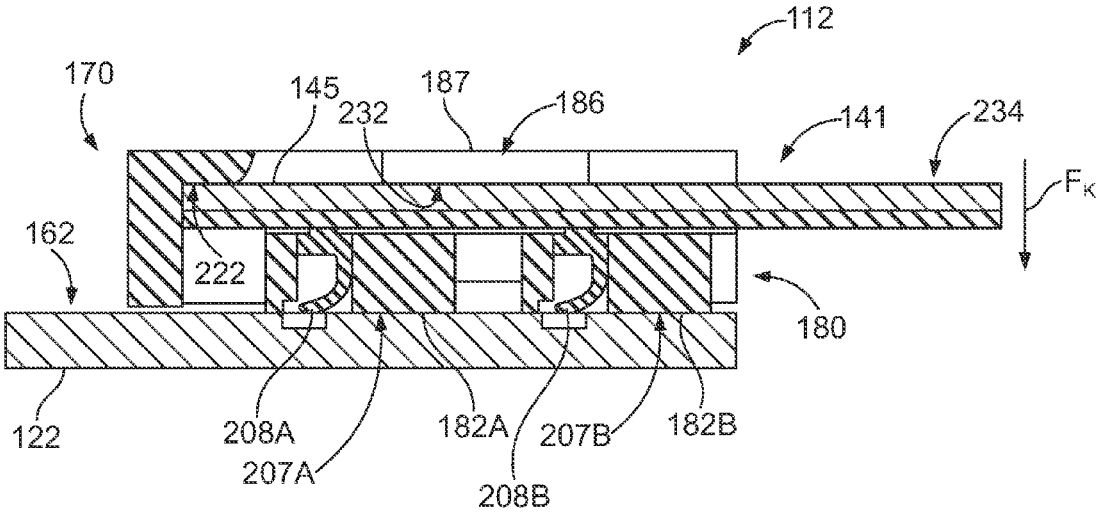
FIG. 6 is a cross-section of a portion of the electronic module package mated with the cable connector assembly.

As the mating end 141 is pivoted toward the module surface 162, the connector contacts 208A continue to resist movement toward the module surface 162. The resilient force $F_R$ collectively formed by the connector contacts 208A supports the mating face 207A above the module surface 162 until the lever section 220 engages the load surface 222. At this time, the lever section 220 applies a leveraging force $F_L$ against the load surface 222 that is directed away from the module surface 162. The leverage wall 193 is structured to withstand the leveraging force $F_E$. With the lever section 220 engaged to the load surface 222, the connector contacts 208A are deflected and the mating face 207A is advanced toward the module surface 162. At some time after the connector contacts 208A are deflected, the connector contacts 208B are also deflected by the module surface 162 and the mating end 141 reaches the mated position as shown in FIG. 6. In the mated position, the connector contacts 208A are electrically connected to the electrical contacts 166A and the connector contacts 208B are electrically connected to the electrical contacts 166B. Accordingly, the lever mechanism of the mating end 141 increases the mechanical advantage so that the mating faces 207A, 207B can be pressed against the module surface 162 and an electrical connection can be established.

In particular embodiments, the receptacle housing 176 and/or the mating end 141 are configured such that the reception space 180 must receive the mating end 141 at an angle with respect to the module surface 162. More specifically, the receptacle housing 176 and/or the mating end 141 may be configured such that the mating end 141 must be at an angle with respect to the module surface 162 when the lever section 220 is initially inserted into the slot region 196. For example, the grip features 199 may prevent the mating end 141 from being aligned and advanced in a linear direction that is parallel to the module surface 162. Moreover, as a practical matter, the connector contacts 208A, 208B may be configured such that the connector contacts 208A, 208B must approach the module surface 162 from above in order to avoid the risk of damage to the connector contacts 208A, 208B.

FIG. 6 shows the electronic module package 112 when the mating end 141 is in the mated position. In the mated position, the mating end 141 is fully inserted into the reception space 180 and the electrical connectors 182A, 182B are electrically engaged with the interposer 122. The mating faces 207A, 207B interface with the module surface 162. For example, the mating faces 207A, 207B can directly contact the module surface 162 or may be in close proximity to the module surface 162.

In an exemplary embodiment, the connector receptacle 170 uses the retention devices 184 (FIG. 2) and 186 to maintain the electrical connection and prevent the mating end 141 from being inadvertently withdrawn. The retention devices 184, 186 may be used to secure or hold the mating end 141 within the reception space 180. For example, the retention devices 184, 186 can apply a locking force $F_K$ toward the module surface 162 to maintain the electrical connection. For example, the actuator 187 has an engagement surface 232 that faces the module surface 162. The engagement surface 232 is configured to engage the mating end 141. For example, the engagement surface 232 faces and engages an exterior surface 234 of the stiffener 145. Once the individual's hand is removed, the engagement surface 232 of the actuator 187 prevents the resilient connector contacts 208A, 208B from moving the mating end 141 away from the module surface 162. The engagement surface 232, the engagement surface (not shown) of the actuator 185, and the load surface 222 each engage the exterior surface 234. In alternative embodiments, the engagement surface 232, the engagement surface of the actuator 185, and the load surface 222 can engage other parts of the mating end 141. The engagement surface 232, the engagement surface of the actuator 185 (FIG. 2), and the load surface 222 may be spaced apart from each other to achieve a desired distribution in force. For example, in an exemplary embodiment, the locking force $F_K$ presses the electrical connectors 182A, 182B in a direction toward the module surface 162 in a substantially evenly distributed manner.

Figure 7:
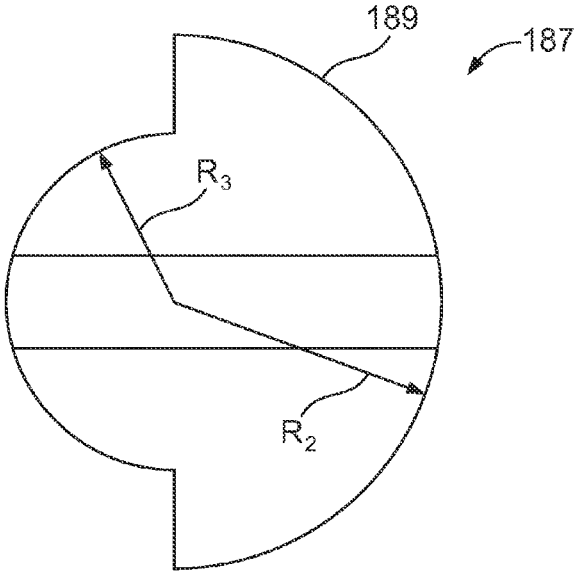
FIG. 7 is a top-down view of a retention device that may be used in the communication system of FIG. 1.

FIG. 7 is a top-down view of the actuator 187. The actuator 187 is configured to prevent the mating end 141 (FIG. 1) from being removed from the reception space 180 (FIG. 2) when the actuator 187 is in a first position and also to allow the mating end 141 to be removed when the actuator 187 is a second position. More specifically, the contoured head 189 may have a varying shape. As shown, the contoured head 189 can comprise two semi-circles having different radii $R_2$ and $R_3$. The radius $R_2$ is greater than the radius $R_3$. Accordingly, when the actuator 187 is rotated to an unlocked position, the shorter radius $R_3$ allows the mating end 141 to be removed. When the actuator 187 is rotated to a locked position, the longer radius $R_2$ prevents the mating end 141 from being removed. More specifically, the engagement surface 232 (FIG. 6) is located over the stiffener 145 (FIG. 3) when the actuator 187 is in the locked position, but not located over the stiffener 145 when the actuator 187 is in the unlocked position.

Although not shown, the engagement surface 232 in some embodiments may be shaped to increase the locking force $F_K$ (FIG. 6). For example, the contoured head 189 may function like a camming mechanism that pushes the mating end 141 further toward the module surface 162 (FIG. 2). For example, as the actuator 187 is rotated, the contoured head 189 may increase in thickness thereby further pressing the mating end 141 toward the module surface 162.

Other types of retention devices may be used in alternative embodiments. For example, the actuator may be a threaded fastener that extends through the mating end 141 (e.g., in a space between the electrical connectors 182A, 182B shown in FIG. 3). When the mating end 141 is in the mated position, the actuator may then be screwed into the interposer 122 (FIG. 1). Alternatively, the actuators may be clips or latches. After the mating end 141 is placed into the mated position, the clips or latches may be actuated to press down upon the mating end 141.

FIG. 8 is a perspective view of a portion of a communication assembly 304, which may have similar components as the communication assembly 104 (FIG. 1). The communication assembly 304 includes an electronic module package 312 having an interposer 322 and an electronic module 320 mounted onto the interposer 322. The electronic module package 312 also includes I/O ports 324, 326 including connector receptacles 370, 376. The connector receptacles 370, 376 are similar to the connector receptacle 170 (FIG. 2) and are configured to receive mating ends 341, 351 of cable connector assemblies 340, 350.

As shown, the mating end 341 includes a circuit board 360 having opposite board surfaces 362, 364. The mating end 341 also includes a connector sub-assembly 366 that is coupled to the board surface 362. The cable connector assembly 340 includes a flex cable 374 that includes a plurality of twin-axial cables 375. Each twin-axial cable 375 includes a differential pair of conductors within a common shield or jacket. The connector sub-assembly 366 includes ground shields 371-373. Each of the ground shields 371-373 receives a number of twin-axial cables 375. The twin-axial cables 375 are terminated to the circuit board 360 within the respective ground shields 371-373. Although not shown, the mating end 341 also includes electrical connectors coupled to the board surface 364 that are similar to the electrical connectors 182A, 182B (FIG. 3).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electronic module package comprising:

an electronic module configured to receive input signals, process the input signals, and provide output signals;

an interposer comprising a substrate with opposite board and module surfaces, the electronic module being mounted to the module surface, the interposer including electrical contacts along the module surface that are communicatively coupled to the electronic module through the substrate; and a connector receptacle comprising a receptacle housing coupled to the interposer, the receptacle housing including a plurality of housing walls that include a leverage wall that is spaced apart from the interposer, the receptacle housing defining a reception space that is located over and permits access to the electrical contacts, the connector receptacle configured to receive an electrical connector of a connector assembly within the reception space to electrically couple the interposer and the electrical connector, the connector receptacle holding the electrical connector therein in a mated position, wherein the reception space is shaped to receive the electrical connector when the electrical connector is oriented at an angle with respect to the module surface and permit the electrical connector to be pivoted toward the module surface to electrically engage the interposer, the electrical contacts of the interposer being disengaged from the electrical connector when the electrical connector is received within the reception space before being pivoted toward the module surface, the leverage wall being configured to withstand a leveraging force exerted on the leverage wall by a mating end of the connector assembly as the electrical connector is pivoted toward the module surface.

2. The electronic module package of claim 1, wherein the connector receptacle also includes a retention device comprising an actuator that prevents the electrical connector from being removed when in the mated position, wherein the actuator includes a contoured head, the actuator being rotatable between locked and unlocked positions, the contoured head being shaped to prevent the electrical connector from being removed when in the locked position.

3. The electronic module package of claim 1, wherein the receptacle housing includes interior surfaces that partially define the reception space, the interior surfaces including a load surface that faces the module surface, the load surface and the module surface defining a slot region of the reception space therebetween.

4. The electronic module package of claim 1, wherein the connector receptacle is a first connector receptacle, the electronic module package including a second connector receptacle, the second connector receptacle having a reception space located over and permitting access to the electrical contacts.

5. The electronic module package of claim 1, wherein the connector receptacle also includes a retention device, the retention device comprising a movable actuator having a contoured head that includes first and second semi-circles comprising first and second radii, the first radius being shorter than the second radius, the actuator being rotatable between a locked position wherein the second radius prevents the electrical connector from being removed from the reception space and an unlocked position wherein the first radius allows the electrical connector to be removed from the reception space.

6. The electronic module package of claim 1, wherein the electrical connector is mounted to a flex cable, the connector receptacle being configured to physically contact the flex cable when the electrical connector is received within the reception space of the connector receptacle.

7. A communication assembly comprising:

an electronic module package comprising an interposer with opposite board and module surfaces and an electronic module mounted to the module surface, the electronic module package also including electrical contacts along the module surface that are communicatively coupled to the electronic module through the interposer;

a connector receptacle comprising a receptacle housing coupled to the interposer, the receptacle housing defining a reception space that is located over and permits access to the electrical contacts; and a cable connector assembly comprising a flex cable and an electrical connector coupled to a mating end of the cable connector assembly, the electrical connector having connector contacts;

wherein the connector receptacle is configured to receive the mating end within the reception space to electrically couple the electrical contacts and the connector contacts, the connector receptacle holding the electrical connector in a mated position, and wherein the connector receptacle also includes a retention device, the retention device comprising a movable actuator having a contoured head that includes first and second semi-circles comprising first and second radii, the first radius being shorter than the second radius, the actuator being rotatable about an axis that extends approximately perpendicular to the interposer between a locked position wherein the second radius prevents the electrical connector from being removed from the reception space and an unlocked position wherein the first radius allows the electrical connector to be removed from the reception space.

8. The communication assembly of claim 7, wherein the cable connector assembly includes a stiffener coupled to the flex cable at the mating end.

9. The communication assembly of claim 8, wherein the stiffener has a length that extends from proximate to a distal cable edge of the mating end to beyond the electrical connector.

10. The communication assembly of claim 8, wherein the receptacle housing includes a load surface that faces the module surface and defines a slot region therebetween, the receptacle housing shaped to receive the stiffener within the slot region at an acute angle with respect to the module surface.

11. The communication assembly of claim 7, wherein the flex cable comprises one of a flex circuit or a bundle of twin-axial cables.

12. The communication assembly of claim 7, wherein the flex cable has opposite first and second sides, the electrical connector being terminated to the first side of the flex cable at the mating end, the cable connector assembly also including a stiffener that is coupled to the second side at the mating end, the stiffener having a length that extends from proximate to a distal cable edge of the mating end to beyond the electrical connector, the electrical connector configured to engage the electrical contacts when inserted into the reception space.

13. The communication assembly of claim 7, wherein the electronic module package is a first electronic module package and the electronic module is a first electronic module, the communication assembly further comprising a primary circuit board and a second electronic module package having a second electronic module, the first and second electronic module packages being mounted to the primary circuit board, wherein the interposer of the first electronic module package and the cable connector assembly provide an electrical path from the first electronic module to the second electronic module that does not extend through the primary circuit board.

14. The communication assembly of claim 7, wherein the connector receptacle is configured such that the connector contacts of the electrical connector must approach the module surface of the interposer from above to electrically couple the connector contacts and the electrical contacts.

15. A communication system comprising:

an interposer comprising a substrate with opposite board and module surfaces; and a connector receptacle comprising a receptacle housing that is coupled to the interposer and that defines a reception space, the reception space being located over and permitting access to electrical contacts of the interposer; and a cable connector assembly having a mating end and comprising a flex cable with opposite first and second sides, the cable connector assembly including an electrical connector terminated to the first side of the flex cable at the mating end and also a stiffener coupled to the second side at the mating end, the stiffener having a length that extends from proximate to a distal cable edge of the mating end to beyond the electrical connector, the electrical connector configured to engage the electrical contacts when inserted into the reception space, wherein the reception space is shaped to receive the electrical connector when the electrical connector is oriented at an angle with respect to the module surface and permit the electrical connector to be pivoted toward the module surface to electrically engage the interposer, the electrical contacts of the interposer being disengaged from the electrical connector when the electrical connector is received within the reception space before being pivoted toward the module surface.

16. The communication assembly of claim 15, wherein the electrical connector is positioned a distance away from the distal cable edge, the mating end including a load section that extends between the distal cable edge and the electrical connector, the load section including a portion of the stiffener.

17. The communication assembly of claim 15, wherein the electrical connector includes a connector body having a mating face and a plurality of connector contacts that project beyond the mating face, the mating face extending parallel to the first side, the connector contacts configured to be deflected toward the mating face.

* * * * *